US006051920A

United States Patent [19]

Kim et al.

[11] Patent Number: 6,051,920

[45] Date of Patent: Apr. 18, 2000

[54] FOCUSING ELECTRODE IN ELECTRON GUN FOR COLOR CATHODE RAY TUBE

[75] Inventors: Hyun Cheol Kim, Kyungsangbuk-do; Ki Bog Son, Daeku-si, both of Rep. of Korea

[73] Assignee: LG Electronics Inc., Seoul, Rep. of Korea

[21] Appl. No.: 09/028,993

[22] Filed: Feb. 25, 1998

[30] Foreign Application Priority Data

| | | | |
|---|---|---|---|
| Feb. 28, 1997 | [KR] | Rep. of Korea | 97 6691 |
| Mar. 6, 1997 | [KR] | Rep. of Korea | 97 7462 |
| Mar. 7, 1997 | [KR] | Rep. of Korea | 97 7623 |
| Apr. 4, 1997 | [KR] | Rep. of Korea | 97 7093 |

[51] Int. Cl.[7] ..... H01J 29/50

[52] U.S. Cl. ..... 313/414; 313/449; 313/412; 315/382

[58] Field of Search ..... 313/412, 413, 313/414, 421, 425, 426, 427, 439; 315/382

[56] References Cited

U.S. PATENT DOCUMENTS

| | | | |
|---|---|---|---|
| 5,300,855 | 4/1994 | Kweon | 313/412 |
| 5,739,630 | 4/1998 | Shirai et al. | 313/412 |
| 5,831,399 | 11/1998 | Ohta et al. | 313/414 |

FOREIGN PATENT DOCUMENTS

| | | |
|---|---|---|
| 7-161308 | 6/1995 | Japan . |
| 7-192653 | 7/1995 | Japan . |

*Primary Examiner*—Nimeshkumar D. Patel
*Assistant Examiner*—Joseph Williams
*Attorney, Agent, or Firm*—Fleshner & Kim, LLP

[57] ABSTRACT

A focusing electrode in an electron gun for a color cathode ray tube comprises: a first focusing electrode including one end with vertical plate electrodes projected toward cathodes in three vertically elongated electron beam through holes, and an inner electrode having three electron beam through holes disposed therein, adapted to be applied of a static voltage; and a second focusing electrode including horizontal plate electrodes respectively formed at upper and lower sides of three electron beam through holes inserted into the vertically elongated electron beam through holes in the first focussing electrode, adapted to be applied of a dynamic voltage synchronous to a deflection of the electron beams, wherein a dynamic quadrupole lens is formed among the vertical plate electrodes, the horizontal plate electrodes, and the inner electrode when applying the dynamic voltage to the second focusing electrode, and the intensity of the dynamic quadrupole lens can be controlled by controlling the depth of the inner electrode which is mounted in the first focusing electrode.

24 Claims, 13 Drawing Sheets

FOCUSING ELECTRODE IN ELECTRON GUN FOR COLOR CATHODE RAY TUBE

BACKGROUND OF THE INVENTION

1. Field of the Invention

The present invention relates to an electron gun in a cathode ray tube for a color TV receiver or an high definition industrial monitor, and more particularly, to a focusing electrode in an electron gun which has a more powerful dynamic quadrupole lens and applicable to cathode ray tubes of similar models.

2. Discussion of the Related Art

The electron gun used in a color cathode ray tube is a device for forming a pixel by focusing three electron beams emitted from cathodes onto a fluorescent surface with red, green, and blue fluorescent materials coated on an inside surface of a screen and illuminating the fluorescent materials.

FIG. 1 illustrates a cross-sectional view of an background art in-line type electron gun, FIG. 2A illustrates a front view of the first focusing electrode shown in FIG. 1, FIG. 2B illustrates a sectional view across line I—I shown in FIG. 2A, FIG. 3A illustrates a front view of the second focusing electrode shown in FIG. 1, and FIG. 3B illustrates a sectional view across line II—II shown in FIG. 3A.

Referring to FIGS. 1 to 3B, the electron gun 1 is provided with a triode part 2 for forming electron beams and a main focusing lens part 3 for focusing the electron beams. The triode part 2 is provided with cathodes 4 for emitting thermal electron beams, a controlling electrode 5 for controlling the thermal electrons, and an accelerating electrode 6 for accelerating the thermal electrons toward the screen. The main focusing lens part 3 disposed next to the triode part 2 includes a focusing electrode 7 and an anode 8. The focusing electrode 7 is provided with a first focusing electrode 71 having vertically elongated rectangular electron beam through holes 712 on one end 711 and adapted to be applied of a low static voltage, and a second focusing electrode 72 having horizontally elongated rectangular electron beam through holes 722 on one end 721 facing the first focusing electrode 71 and adapted to be applied of a high dynamic voltage synchronous to a deflection of the electron beams. The anode 8 is disposed next to the second focusing electrode 72 and adapted to be applied of a positive voltage.

Upon application of required voltages to the electrodes, the electron beams are controlled and accelerated to a required speed by the controlling electrode 5 and the accelerating electrode 6. The electron beams then pass through the dynamic quadrupole lens generated by a voltage difference between the static voltage of the first focusing electrode 71 and the varying voltage of the second focusing electrode 72.

In the dynamic quadrupole lens, the electron beams are applied of a focusing power stronger in the horizontal direction when the electron beams pass through the vertically elongated rectangular electron beam through holes in the first focusing electrode which is involved in focusing of the electron beam as the electrode is applied of a low static voltage and applied of a diverging power stronger in the vertical direction when the electron beams pass through the horizontally elongated rectangular electron beam through holes in the second focusing electrode which is involved in diverging the electron beams as the electrode is applied of the high dynamic voltage.

Accordingly, the electron beams are elongated in vertical direction by the dynamic quadrupole lens. Then, the electron beam, elongated in the vertical direction, is converged by a main focusing static lens formed by a voltage difference between the second focusing electrode 72 and the anode 8.

Thereafter, the electron beams are finally accelerated by the positive voltage toward the screen and deflected by a non-uniform magnetic field formed by deflection yokes (not shown). The non-uniform magnetic field elongates the electron beams in the horizontal direction, thereby causing haze which is a thin dispersion of an image on upper and lower sides of a spot of the electron beams on the screen though it can correct a convergence of the electron beams. However, as explained, the electron beams are elongated in the vertical direction in advance by the dynamic quadrupole lens, the electron beams are not elongated in the horizontal direction seriously by the non-uniform magnetic field.

In the meantime, there are cases when a more powerful non-uniform magnetic field, subsequently with a more powerful dynamic quadrupole electrode, is required. However, there has been a limitation in providing a more powerful dynamic quadrupole lens only by using aspect ratios of the electron beam pass through holes in the first, and second focusing electrodes formed in respective ends of the first, and second focusing electrodes which have limits in sizes.

Further, the background art electron gun was cumbersome in designing different first, and second focusing electrodes for providing dynamic quadrupole lenses of different power for color cathode ray tubes of models not so much different in their sizes.

SUMMARY OF THE INVENTION

Accordingly, the present invention is directed a focusing electrode in an electron gun for a color cathode ray tube that substantially obviates one or more of the problems due to limitations and disadvantages of the related art.

An object of the present invention is to provide a focusing electrode in an electron gun for a color cathode ray tube which can provide a more powerful dynamic quadrupole lens between first and second focusing electrodes without substantial change of the focusing electrode sized in an electron gun for a color cathode ray tube.

Another object of the present invention is to provide a focusing electrode in an electron gun for a color cathode ray tube which is applicable to color cathode ray tubes of similar models in sizes.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, a focusing electrode in an electron gun for a color cathode ray tube according to the present invention comprises: a first focusing electrode including one end with vertical plate electrodes projected toward cathodes in three vertically elongated electron beam through holes, and an inner electrode having three electron beam through holes disposed therein, adapted to be applied of a static voltage; and a second focusing electrode including horizontal plate electrodes respectively formed at upper and lower sides of three electron beam through holes inserted into the vertically elongated electron beam through holes in the first focusing electrode, adapted to be applied of a dynamic voltage synchronous to a deflection of the electron beams, wherein a dynamic quadrupole lens is formed among the vertical plate electrodes, the horizontal plate electrodes, and the inner electrode when applying the dynamic voltage to the second focusing electrode, and the intensity of the dynamic quadrupole lens can be controlled by controlling the depth of the inner electrode which is mounted in the first focusing electrode.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENT

Figure 1:
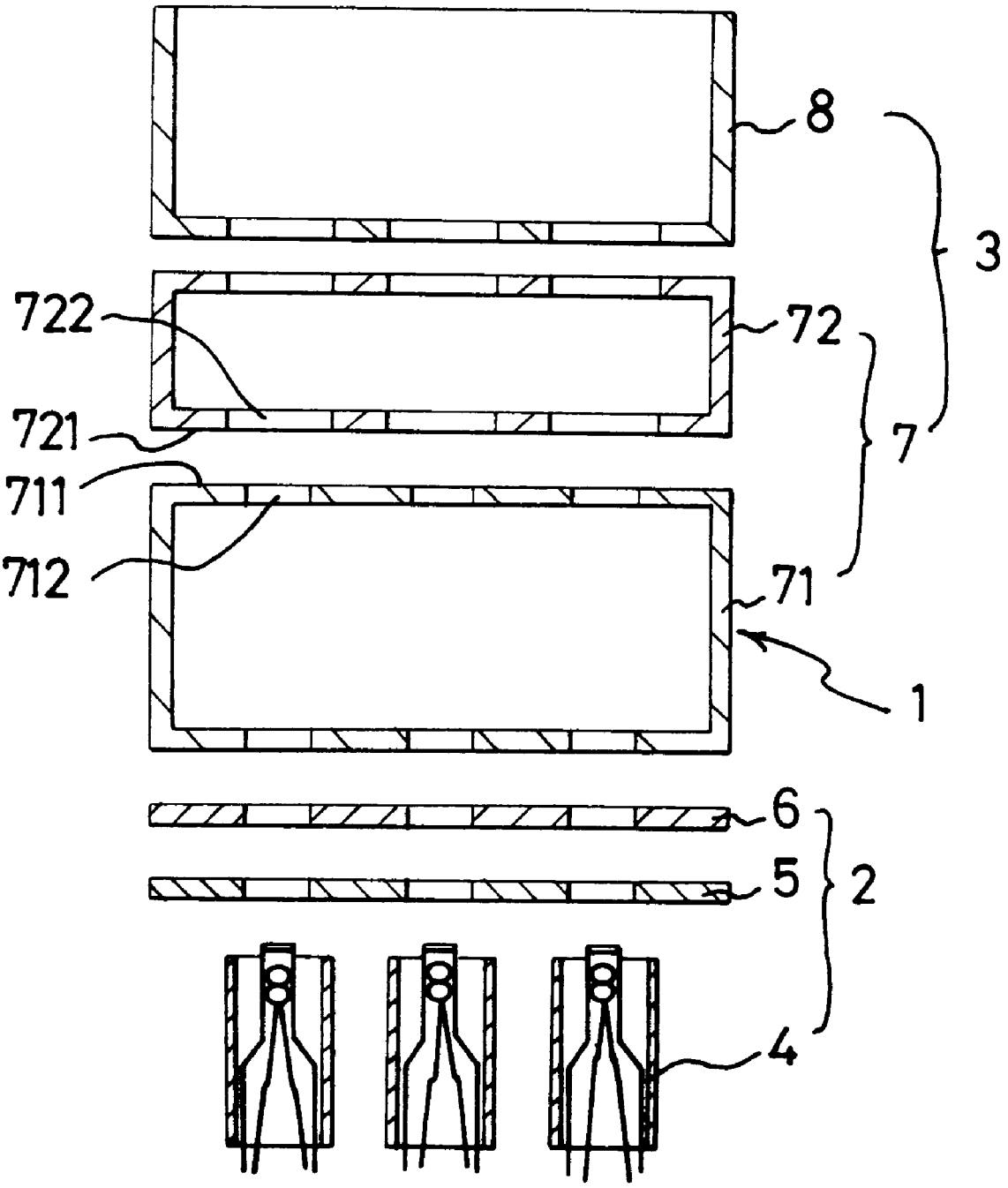
FIG. 1 Prior Art
FIG. 1 is a cross-sectional view of an background art in-line type electron gun.
Figure 2A:
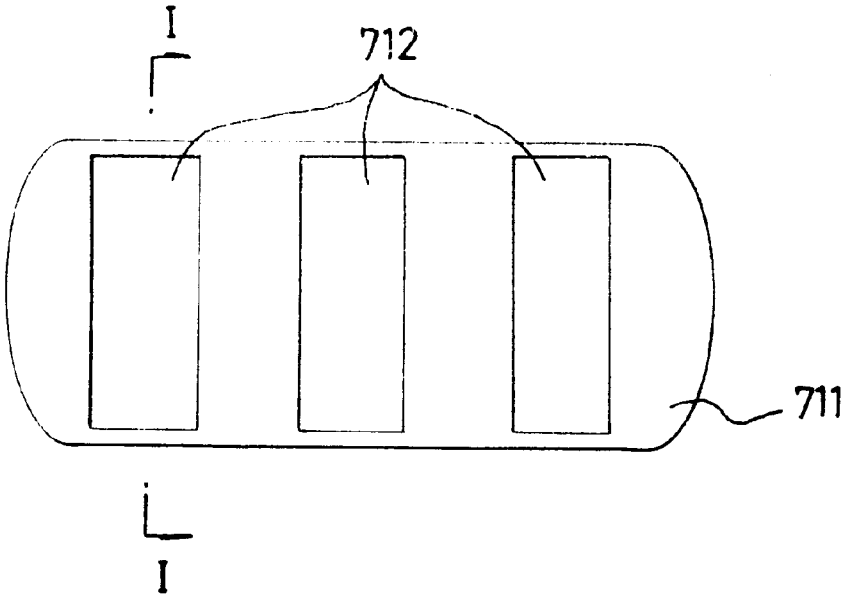
FIG. 2A Prior Art
FIG. 2A is a front view of the first focusing electrode shown in FIG. 1.
Figure 2B:
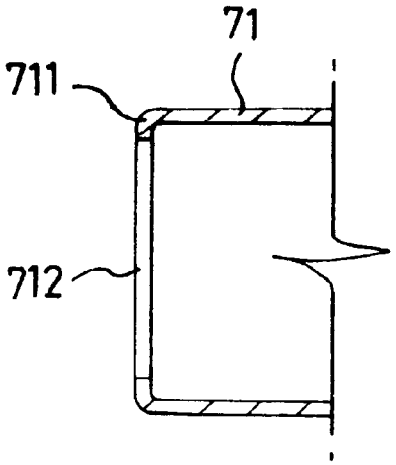
FIG. 2B Prior Art
FIG. 2B is a sectional view across line I—I shown in FIG. 2A.
Figure 3A:
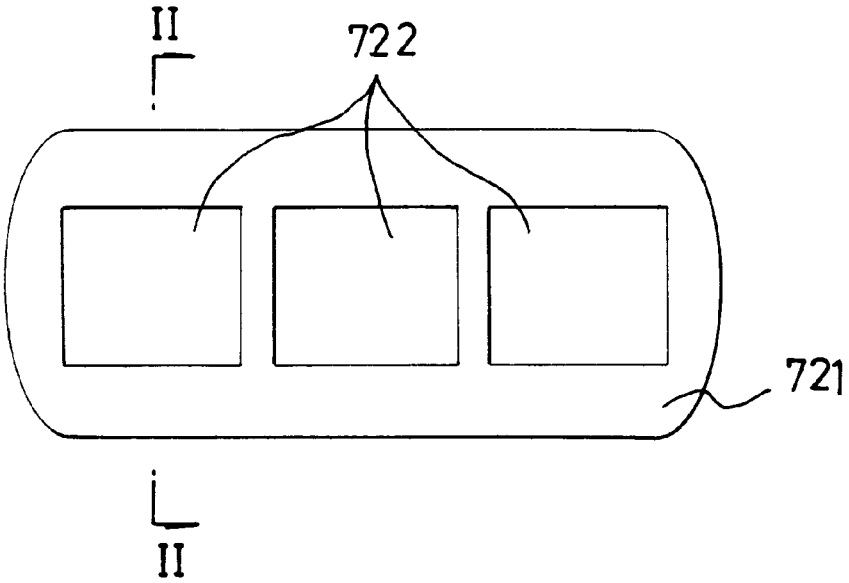
FIG. 3A Prior Art
FIG. 3A is a front view of the second focusing electrode shown in FIG. 1.
Figure 3B:
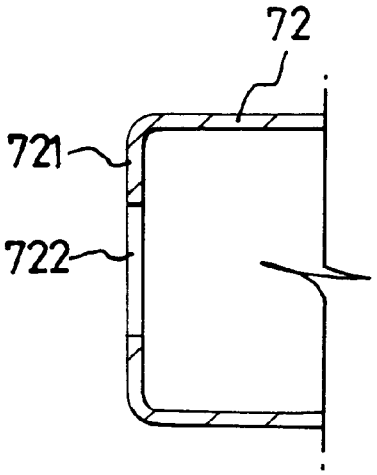
FIG. 3B Prior Art
FIG. 3B is a sectional view across line II—II shown in FIG. 3A.
Figure 4:
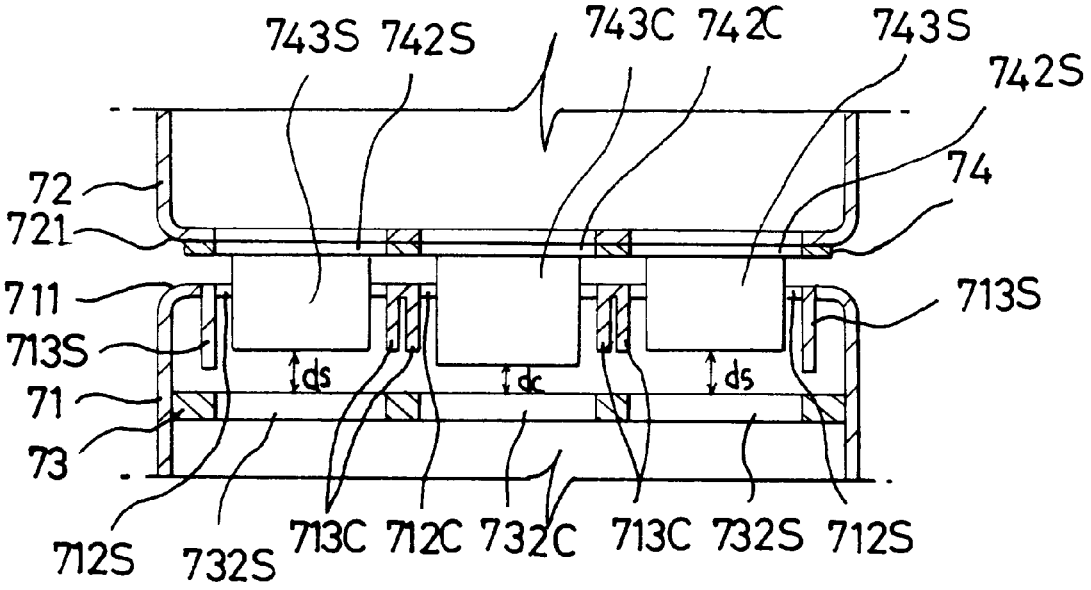
FIG. 4 is a cross sectional view of a focusing electrode of an electron gun according to the first embodiment of the present invention.
Figure 5A:
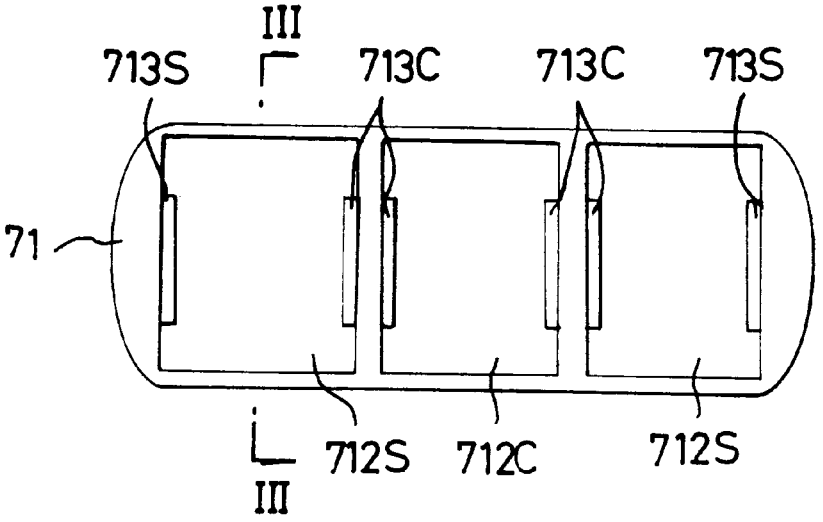
FIG. 5A is a front view of the first focusing electrode shown in FIG. 4.
Figure 5B:
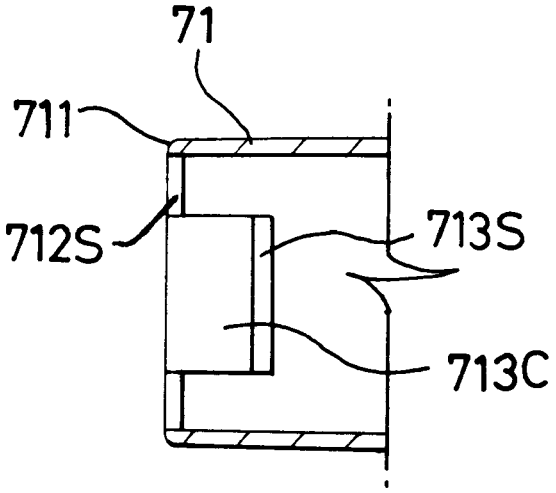
FIG. 5B is a sectional view across line III—III of FIG. 5A.
Figure 6A:
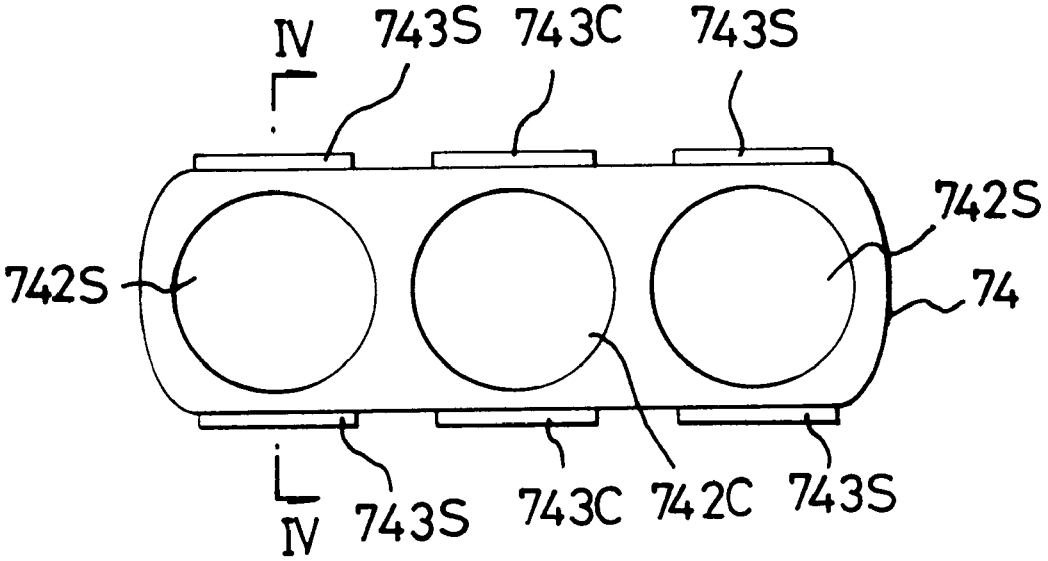
FIG. 6A is a front view of the second focusing electrode shown in FIG. 4 to which a correction electrode having circular electron beam through holes is attached.
Figure 6B:
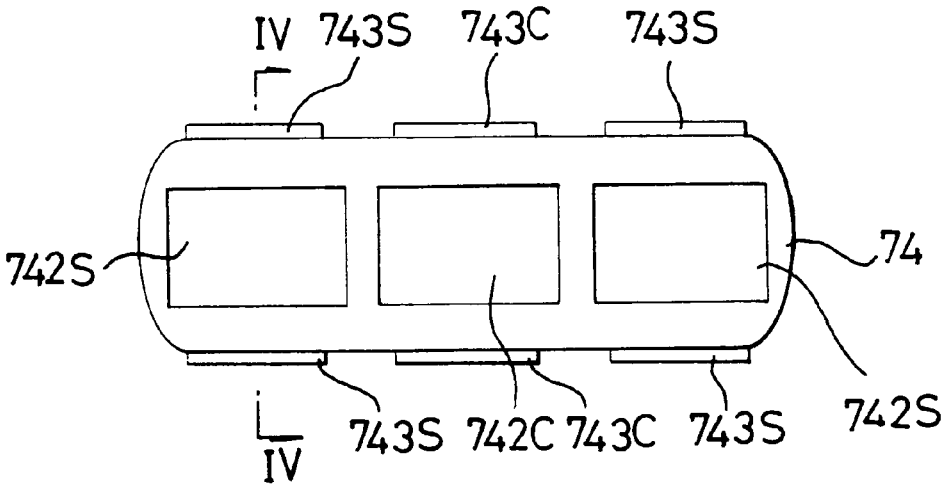
FIG. 6B is a front view of the second focusing electrode shown in FIG. 4 to which another correction electrode having horizontally elongated rectangular electron beam through holes.
Figure 6C:
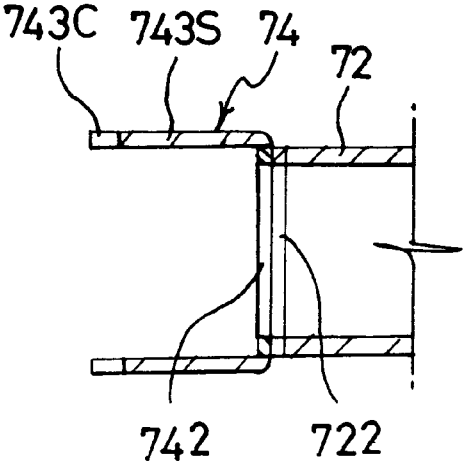
FIG. 6C is a sectional view across line IV—IV shown in FIG. 6A or 6B.

Reference will now be made in detail to the preferred embodiments of the present invention, examples of which are illustrated in the accompanying drawings. FIG. 4 is a cross-sectional view of a focusing electrode of an electron gun according to the first embodiment of the present invention, FIG. 5A is a front view of the first focusing electrode shown in FIG. 4, FIG. 5B is a sectional view across line III—III of FIG. 5A, FIG. 6A is a front view of the second focusing electrode shown in FIG. 4 to which a correction electrode having circular electron beam through holes is attached, FIG. 6B is a front view of the second focusing electrode shown in FIG. 4 to which another correction electrode having horizontally elongated rectangular electron beam through holes, and FIG. 6C is a sectional view across line IV—IV shown in FIG. 6A or 6B. The same reference numerals are used for parts identical to the parts of the background art.

Referring to FIG. 4, the focusing electrode in an electron gun for a color cathode ray tube in accordance with the first embodiment of the present invention includes a first focusing electrode 71 and a second focusing electrode 72. The first focusing electrode 71 has one end 711 with vertical plate electrodes 713*c* and 713*s* projected toward cathodes in three vertically elongated electron beam through holes 712*c* and 712*s* and an inner electrode 73 having three electron beam through holes 732*c* and 732*s* disposed therein, and is adapted to be applied of a static voltage. The second focusing electrode 72 has horizontal plate electrodes 743*c* and 743*s* respectively formed at upper and lower sides of three electron beam through holes 742 inserted into the vertically elongated electron beam through holes 712*c* and 712*s* in the first focusing electrode 71, and is adapted to be applied of a dynamic voltage synchronous to a deflection of the electron beams.

As shown in FIGS. 4 to 5B, since the vertical plate electrodes 713*c* and 713*s* are provided at both sides of the vertically elongated rectangular through holes 712*c* and 712*s* in the horizontal direction in parallel in the first focusing electrode 71, the electron beams undergo a more powerful focusing in the horizontal direction when the electron beams pass through the vertically elongated rectangular electron beam through holes 712*c* and 712*s* in the first focusing electrode 71 which is involved in focusing of the electron beams as the low static voltage is applied thereto. Of lengths of the vertical plate electrodes 713*c* and 713*s*, lengths of the vertical plate electrodes 713*s* at outer sides of outer electron beam pass through holes 712*s* are preferably the longest for preventing weakening of a convergence of outer electron beams.

Referring to FIGS. 6A to 6C, the horizontal plate electrodes 743*c* and 743*s* are weld-attached to upper and lower sides of the three electron beam through holes 742*c* and 742*s* in a correction electrode 74 which is mounted in one end 721 of the second focusing electrode 72. Thus, the high dynamic voltage is applied to the second focusing electrode 72 which is involved in divergence of the electron beams. The electron beams undergo a more powerful divergence in the vertical direction when the electron beams pass through the electron beam through holes 742*c* and 742*s* in the correction electrode 74.

At this time, the electron beam through holes 742*c* and 742*s* formed in the correction electrode 74 may have either circular shapes as shown in FIG. 6A, or horizontally elongated rectangular shapes as shown in FIG. 6B for more powerful divergence of the electron beams.

Figure 7A:
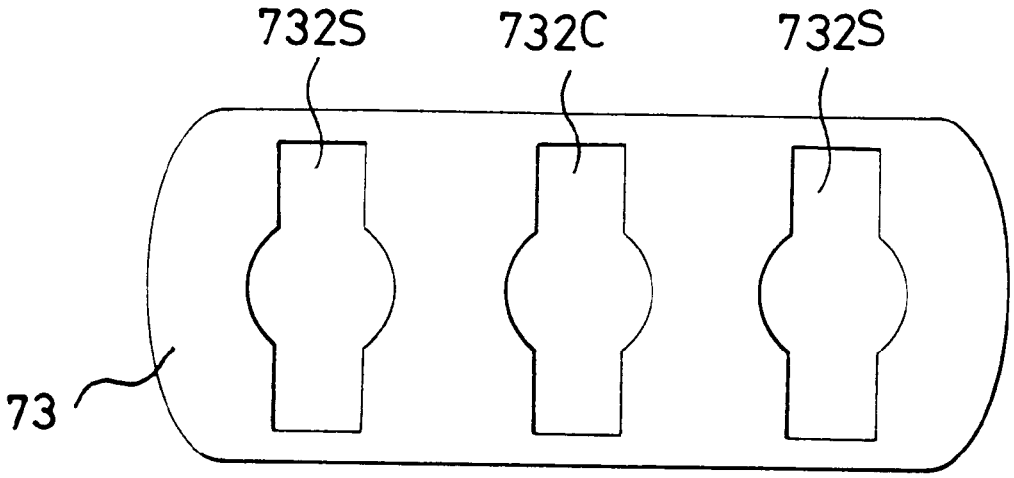
FIGS. 7A to 7D and FIGS. 8A to 8C are front views of an inner electrode mounted into the first focusing electrode, having various electron beam through holes, according to the present invention.
Figure 7B:
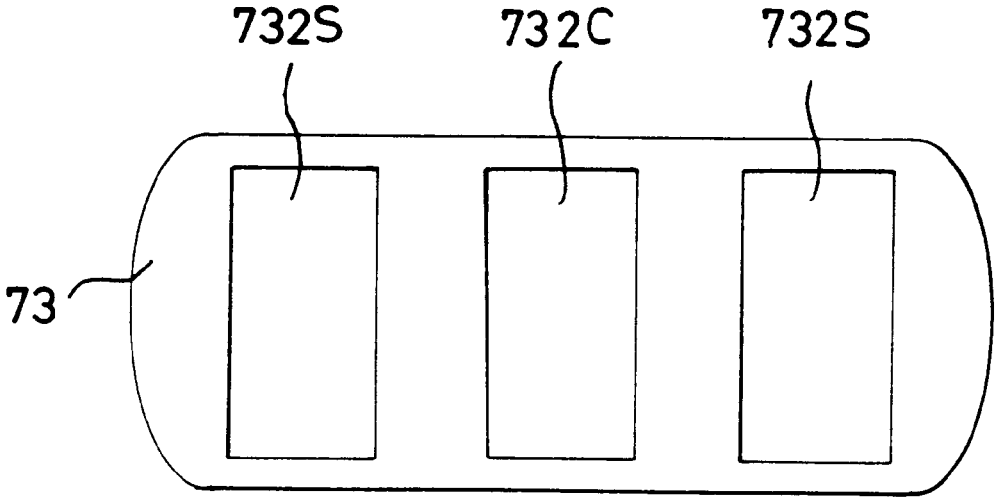
Figure 7C:
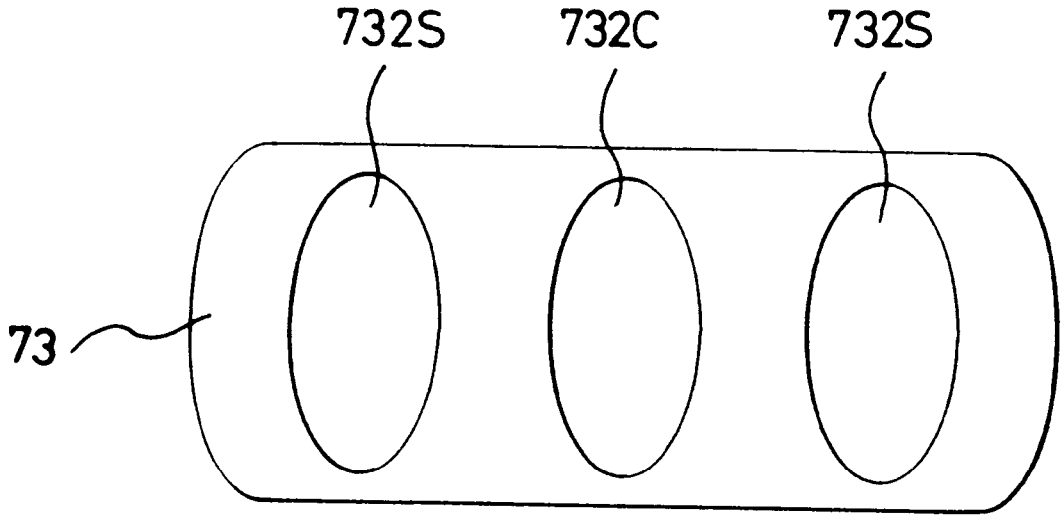

Referring to FIGS. 7A to 7C, the three electron beam through holes 732*c* and 732*s* formed in the inner electrode 73 have any one of vertically elongated shapes such as a key hole, rectangular shapes, or elliptical shapes. The low static voltage is applied to the inner electrode 73 which is involved in focusing of the electron beams. The electron beams undergo more powerful focusing in the horizontal direction when the electron beams pass through the vertically elongated electron beam through holes 732*c* and 732*s* in the inner electrode 73.

Figure 7D:
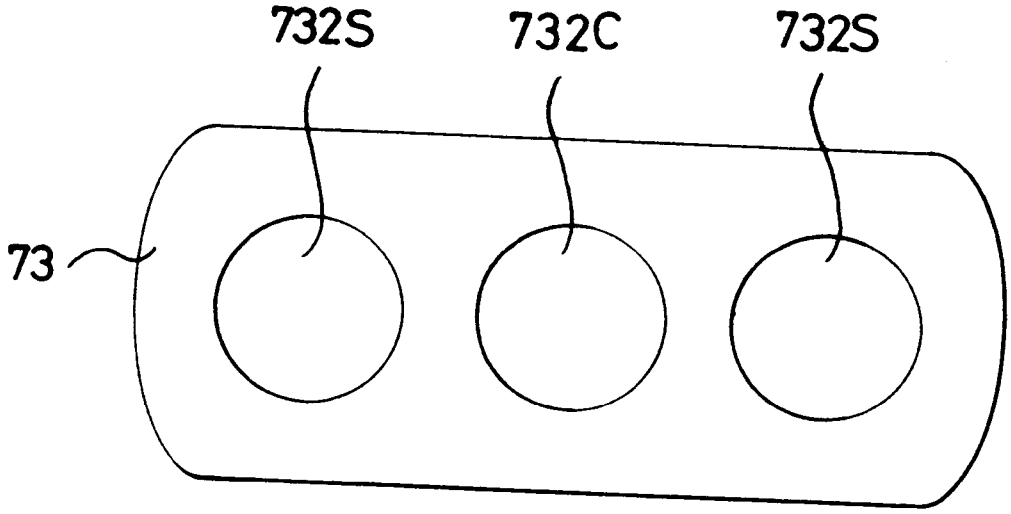

Further, as shown in FIG. 7D, the electron beam through holes 732*c* and 732*s* in the inner electrode 73 may have circular shapes for more powerful focusing in the vertical direction.

Therefore, a dynamic quadrupole lens is formed for more powerful focusing of the electron beams in the horizontal direction and more powerful divergence of the electron beams in the vertical direction.

The dynamic quadrupole lens of the present invention is relatively more powerful than the conventional dynamic quadrupole lens generated by aspect ratios of the electron beams formed in one ends of the first and second focusing electrodes 71 and 72.

Further, in the present invention, the intensity of the dynamic quadrupole lens can be controlled in the electron gun by controlling the depth that the inner electrode 73 is mounted in the first focusing electrode 71.

However, if the inner electrode 73 is mounted deeply toward the cathodes 4 in the first focusing electrode 71, horizontal focusing power of the central electron beams as well as the vertical diverging power thereof weaken, thereby transforming shapes of the central electron beams into horizontally elongated shapes.

Figure 8A:
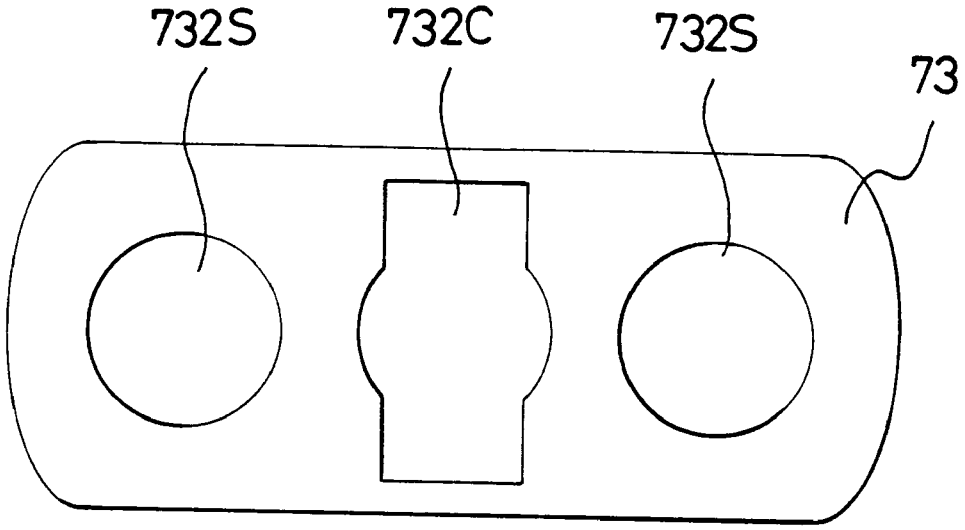
Figure 8B:
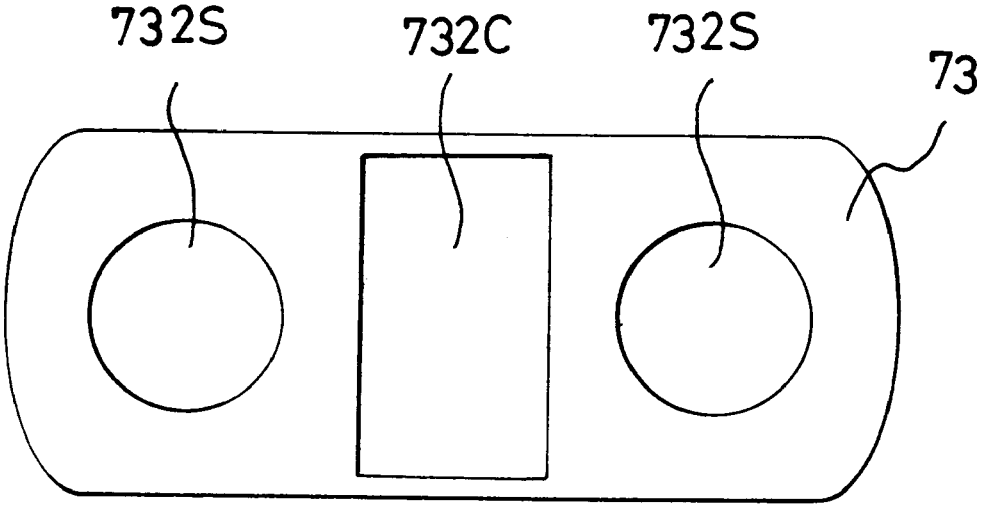
Figure 8C:
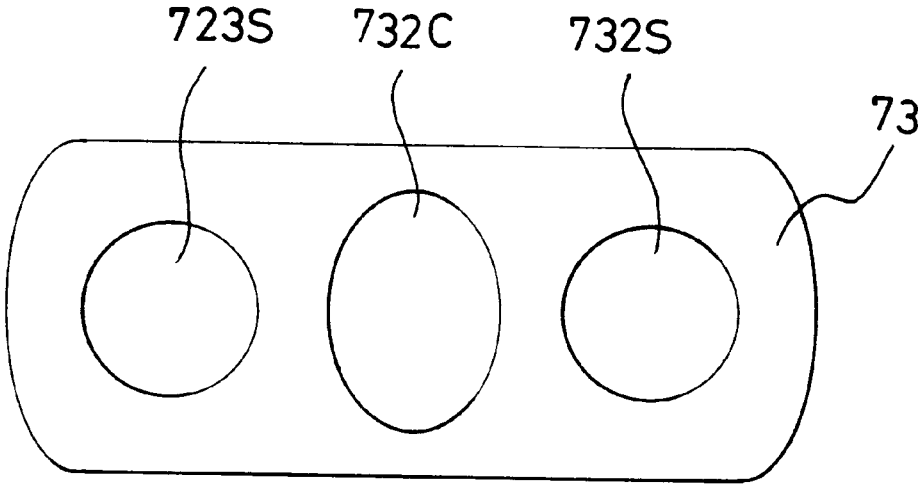

To correct such transformation, as shown in FIGS. 8A to 8C, the electron beam through hole 732*c* in the center of the inner electrode 73 maintains the vertically elongated shape such as a key hole, the rectangular shape, or the elliptical shape while the shapes of the outer electron beam through holes 732*s* are changed to circular shapes. As a result, the central electron beams undergo more powerful focusing in the horizontal direction and more powerful divergence in the vertical direction when the electron beams pass through the electron beam through hole 732*c* in the center of the inner electrode 73, so as to correct the transformation.

As shown in FIG. 4, if powerful divergence of the electron beams in the vertical direction is not sufficient, for more powerful divergence of the central electron beams in the vertical direction, it is necessary to extend the length of the central horizontal plate electrode 743*c* to be longer than the length of the outer horizontal plate electrodes 743*s* in such a manner that the distance dc between a free end of the central horizontal electrode and the inner electrode is closer than the distance ds between a free end of an outer horizontal plate electrode and the inner electrode.

Therefore, the central electron beams can always maintain good circular electron beam spot on a screen regardless of the depth of the inner electrode 73. This has an advantage that the electron gun is applicable to cathode ray tubes of similar models without changing the design of the electron gun.

The electron gun according to the first embodiment of the present invention is suitable for a large sized color cathode tube having a large neck portion which is not limited by whole diameter of the electron gun.

However, in a small sized color cathode tube having a mini neck portion, the electron gun according to the first embodiment of the present invention has limitation in reducing the whole diameter of the electron gun due to the vertical plate electrodes 713*c* and 713*s* formed at both sides of the electron beam through holes 712*c* and 712*s* in the first focusing electrode 71. Therefore, there exists a problem that it is difficult to mount the electron gun according to the first embodiment of the present invention in the small sized color cathode tube having a mini neck portion.

Figure 9:
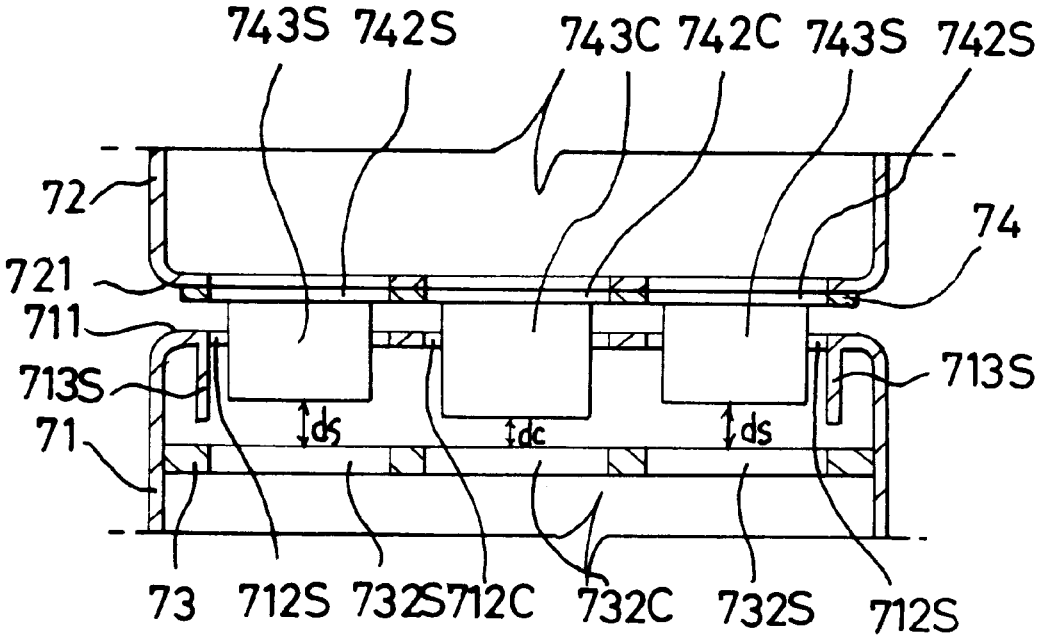
FIG. 9 is a cross-sectional view of a focusing electrode of the electron gun, which is applicable to a mini neck, according to the second embodiment of the present invention.
Figure 10A:
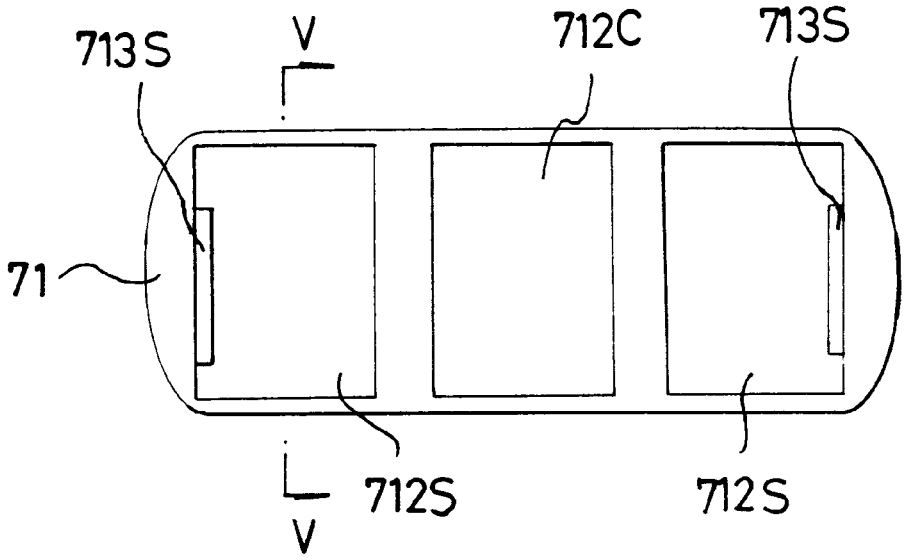
FIG. 10A is a front view of the first focusing electrode shown in FIG. 9.
Figure 10B:
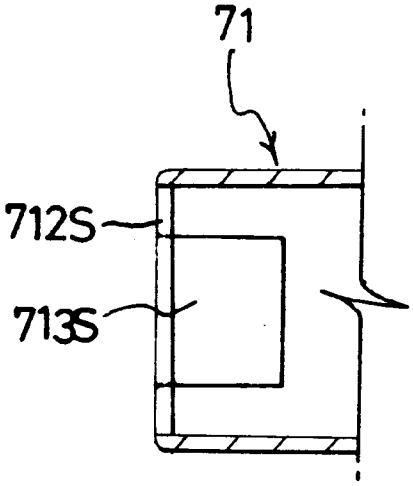
FIG. 10B is a sectional view across line V—V shown in FIG. 10A.

FIG. 9 is a cross-sectional view of a focusing electrode of the electron gun applicable to a mini neck while maintaining the intensity of the dynamic quadrupole lens similar to the first embodiment, according to the second embodiment of the present invention, FIG. 10A is a front view of the first focusing electrode shown in FIG. 9, and FIG. 10B is a sectional view across line V—V shown in FIG. 10A.

Referring to FIGS. 9 to 10B, in the second embodiment of the present invention, the vertical plate electrode 713*c* at both sides of the central electron beam through hole 712*c* in the first focusing electrode 71 and the vertical plate electrodes 713*c* in inner sides of the outer electron beam through holes 712*s* are removed. Only the vertical plate electrodes 713*s* formed at outer sides of the outer electron beam through holes 712*s* remain.

The intensity of the dynamic quadrupole lens, which is weakened by removing the inner vertical plate electrode 713*c*, is compensated by the longer horizontal plate electrodes 743*c* and 743*s*.

In the first and second embodiments of the present invention, the correction electrode 74 is weld-mounted in the second focusing electrode and also the horizontal plate electrodes 743*c* and 743*s* are respectively weld-mounted at upper and lower sides of the electron beam through holes 742*c* and 742*s* in the correction electrode 74.

Figure 11:
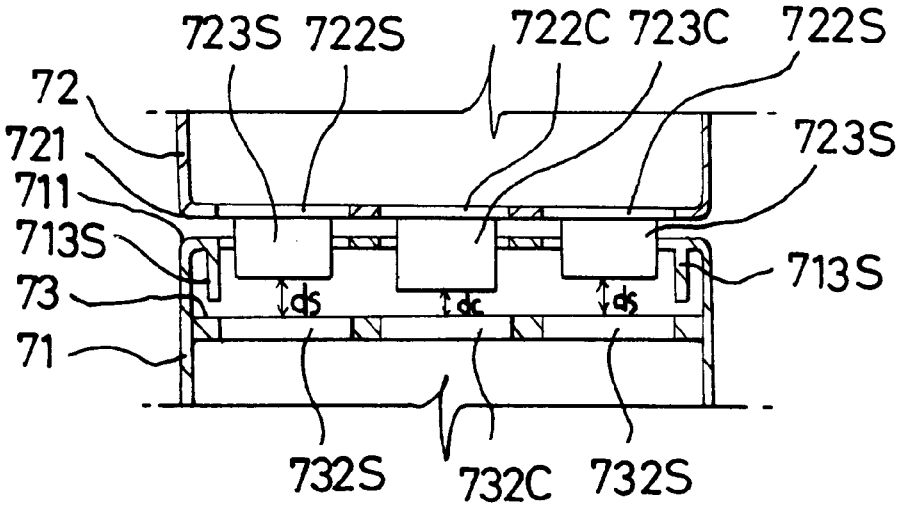
FIG. 11 is a cross-sectional view of a focusing electrode of the electron gun according to the third embodiment of the present invention.
Figure 12A:
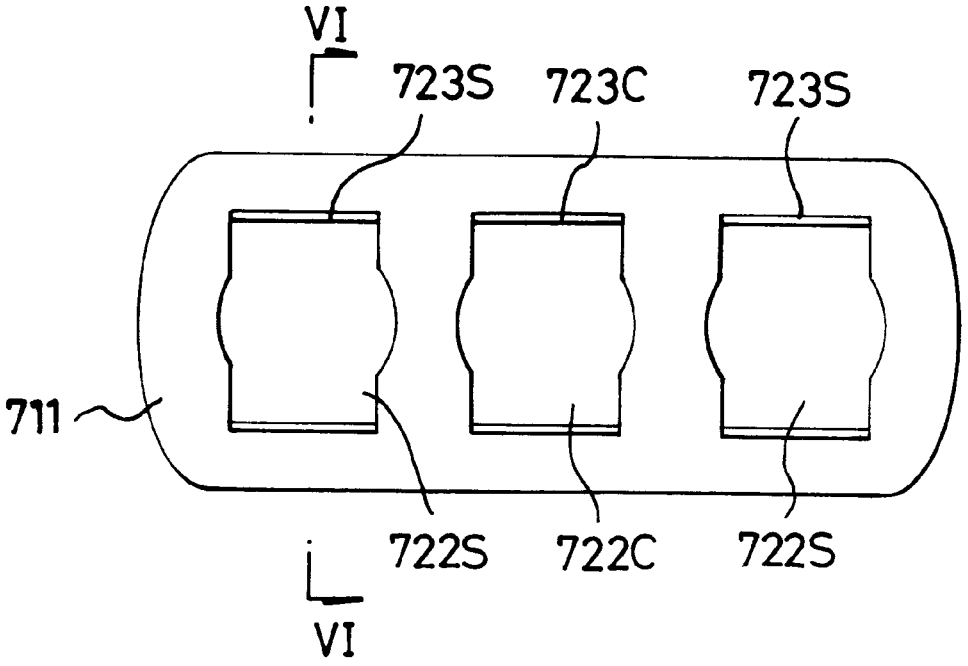
FIG. 12A is a front view of the second focusing electrode shown in FIG. 11.

FIG. 11 is a cross-sectional view of a focusing electrode of the electron gun according to the third embodiment of the present invention. FIG. 12A is a front view of the second focusing electrode shown in FIG. 11, and FIG. 12B is a sectional view across line VI—VI shown in FIG. 12A.

Figure 12B:
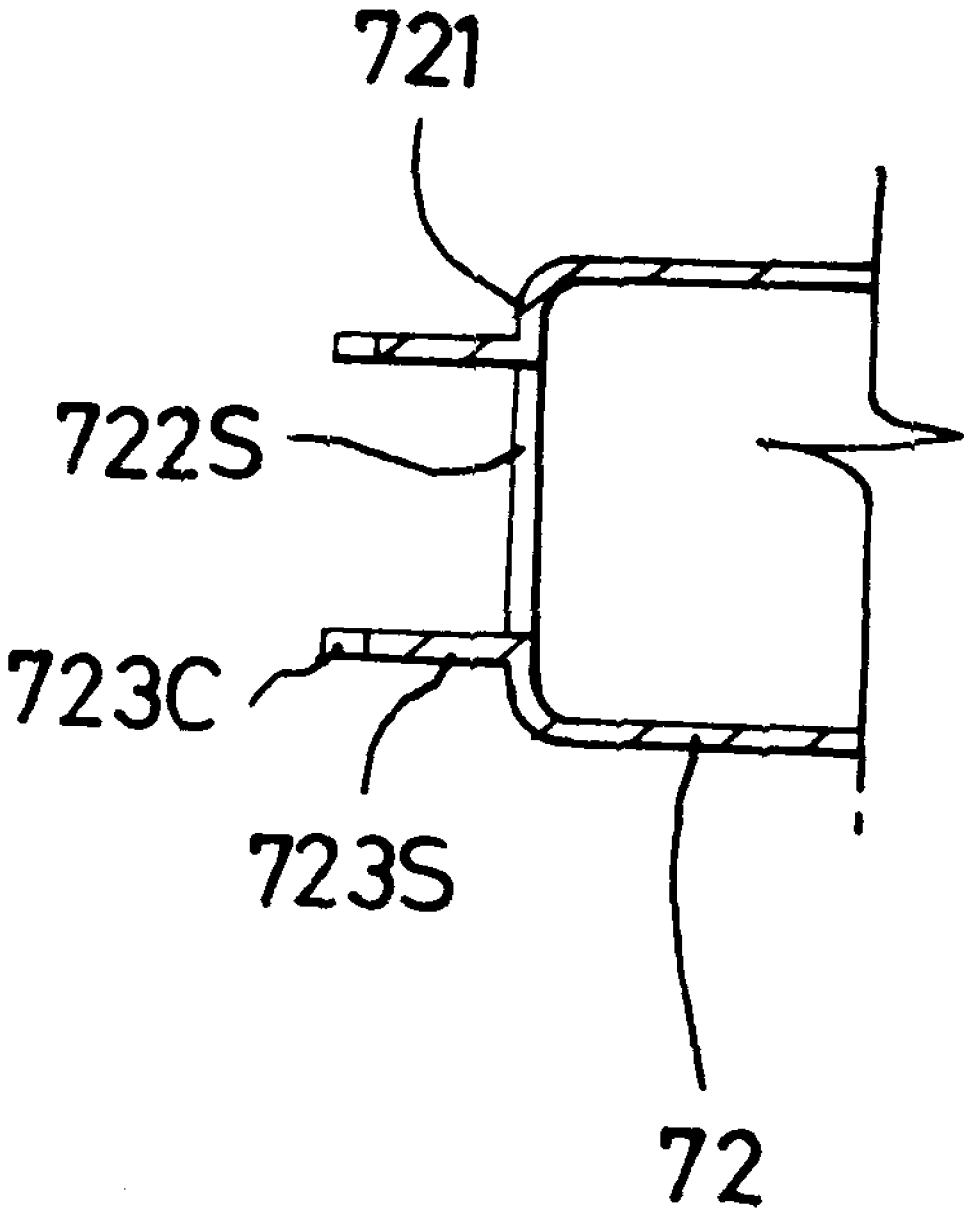
FIG. 12B is a sectional view across line VI—VI shown in FIG. 12A.

Referring to FIGS. 11 to 12B, the electron beam through holes 722*c* and 722*s* such as a key hole are formed on one end of the second focusing electrode 72 facing the first focusing electrode 71. Horizontal burring parts 723*c* and 723*s* are formed toward cathodes at upper and lower sides of the electron beam through holes 722*c* and 722*s*.

In the third embodiment of the present invention, since the electron beam through holes 722*c* and 722*s* and the horizontal burring parts 723*c* and 723*s* are simultaneously formed by simply pressing the one end 721 of the second focusing electrode 72, the process steps can be reduced as compared to the first and second embodiments of the present invention.

As aforementioned, the focusing electrode in the electron gun for a color cathode ray tube according to the present invention has the following advantages.

The focusing electrode according to the present invention provides the horizontal plate electrodes at both sides of the electron beam through hole in the first focusing electrode which is involved in the focusing of the electron beam as the low static voltage is applied to the first focusing electrode, and the inner electrode in the inner side of the first focusing electrode. In addition, the focusing electrode according to the present invention provides the horizontal plate electrodes at the upper and lower sides of the electron beam through holes in the second focusing electrode which is involved in diverging power of the electron beams as the high dynamic voltage is applied to the second focusing electrode.

Therefore, it is possible to enhance the intensity of the dynamic quadrupole lens formed among the vertical plate electrodes, the horizontal plate electrodes, and the inner electrode. Further, since the depth of the inner electrode is controlled depending on a model of the cathode ray tube, the electron gun of the present invention has an advantage that it is applicable to cathode ray tubes of similar models without changing the design of the electron gun.

It will be apparent to those skilled in the art that various modifications and variations can be made in the focusing electrode in the electron gun for a color cathode ray tube according to the present invention without departing from the spirit or scope of the invention. Thus, it is intended that the present invention covers the modifications and variations of the invention provided they come within the scope of the appended claims and their equivalents.

What is claimed is:

1. A focusing electrode in an electron gun for a color cathode ray tube comprising:

a first focusing electrode including one end with vertical plate electrodes projected toward cathodes in three vertically elongated electron beam through holes, and an inner electrode positioned between the cathodes and the vertical plate electrodes having three electron beam through holes disposed therein, adapted to be applied of a static voltage, wherein the inner electrode is spaced apart from the vertical plate electrodes; and a second focusing electrode including horizontal plate electrodes respectively formed at upper and lower sides of three electron beam through holes inserted into the vertically elongated electron beam through holes in the first focusing electrode, adapted to be applied of a dynamic voltage synchronous to a deflection of the electron beams, wherein a dynamic quadrupole lens is formed among the vertical plate electrodes, the horizontal plate electrodes, and the inner electrode when applying the dynamic voltage to the second focusing electrode, and the intensity of the dynamic quadrupole lens can be controlled by controlling the depth of the inner electrode which is mounted in the first focusing electrode.

2. The focusing electrode in an electron gun for a color cathode ray tube as claimed in claim 1, wherein the vertical plate electrodes are formed in parallel in horizontal direction at both sides of the respective electron beam through holes in the first focusing electrode.

3. The focusing electrode in an electron gun for a color cathode ray tube as claimed in claim 2, wherein lengths of the vertical plate electrodes are different from one another.

4. The focusing electrode in an electron gun for a color cathode ray tube as claimed in claim 3, wherein the vertical plate electrodes at outer sides of the outer electron beam through holes are the longest.

5. The focusing electrode in an electron gun for a color cathode ray tube as claimed in claim 4, wherein the horizontal plate electrodes are attached to upper and lower sides of three electron beam through holes in a correction electrode which is mounted on one end of the second focusing electrode.

6. The focusing electrode in an electron gun for a color cathode ray tube as claimed in claim 5, wherein the electron beam through holes of the correction electrode have either circular shapes or horizontal elongated shapes.

7. The focusing electrode in an electron gun for a color cathode ray tube as claimed in claim 4, wherein the horizontal plate electrodes are horizontal burring portions formed in one end of the second focusing electrode toward cathodes.

8. The focusing electrode in an electron gun for a color cathode ray tube as claimed in claim 6, wherein the three electron beam through holes in the inner electrode have any one of key hole shapes, rectangular shapes, elliptical shapes, or circular shapes.

9. The focusing electrode in an electron gun for a color cathode ray tube as claimed in claim 6, wherein a length of the horizontal plate electrode at a center in the second focusing electrode is different from lengths of the outer horizontal plate electrodes.

10. The focusing electrode in an electron gun for a color cathode ray tube as claimed in claim 9, wherein the horizontal plate electrode at the center in the second focusing electrode is the longest.

11. A focusing electrode in an electron gun for a color cathode ray tube comprising:

a first focusing electrode including one end with vertical plate electrodes projected toward cathodes in three vertically elongated electron beam through holes, and an inner electrode having three electron beam through holes disposed therein, adapted to be applied of a static voltage, wherein the vertical plate electrodes are formed only at outer sides of the outer electron beam through holes in the first focusing electrode; and a second focusing electrode including horizontal plate electrodes respectively formed at upper and lower sides of three electron beam through holes inserted into the vertically elongated electron beam through holes in the first focusing electrode, adapted to be applied of a dynamic voltage synchronous to a deflection of the electron beams, wherein a dynamic quadrupole lens is formed among the vertical plate electrodes, the horizontal plate electrodes, and the inner electrode when applying the dynamic voltage to the second focusing electrode, and the intensity of the dynamic quadrupole lens can be controlled by controlling the depth of the inner electrode which is mounted in the first focusing electrode.

12. The focusing electrode of claim 11, wherein the horizontal plate electrodes are attached to upper and lower sides of three electron beam through holes on a correction electrode which is mounted on one end of the second focusing electrode.

13. The focusing electrode of claim 11, wherein the horizontal plate electrodes are horizontal burring portions formed in one end of the second focusing electrode toward cathodes.

14. The focusing electrode of claim 13, wherein the electron beam through holes in the second focusing electrode have key hole shapes.

15. The focusing electrode of claim 14, wherein the three electron beam through holes in the inner electrode have any one of keyhole shapes, rectangular shapes, elliptical shapes, or circular shapes.

16. The focusing electrode of claim 14, wherein a length of the horizontal plate electrode at a center in the second focusing electrode is different from lengths of the outer horizontal plate electrodes.

17. The focusing electrode of claim 16, wherein the horizontal plate electrode at the center in the second focusing electrode is longer than lengths of the outer horizontal plate electrodes, and wherein the electron beam through hole at the center in the inner electrode has a vertically elongated shape and the outer electron beam through holes have circular shapes.

18. The focusing electrode of claim 17, wherein the electron beam through hole at the center in the inner electrode has any one of a key hole shape, a rectangular shape, or an elliptical shape.

19. A focusing electrode in an electron gun for a color cathode ray tube comprising:

a first focusing electrode including one end with vertical plate electrodes projected toward cathodes in three vertically elongated electron beam through holes, and an inner electrode having three electron beam through holes disposed therein, adapted to be applied of a static voltage, wherein the vertical plate electrodes are formed in parallel in horizontal direction at both sides of the respective electron beam through holes in the first focusing electrode, and wherein the vertical plate electrodes at outer sides of the outer electron beam through holes are the longest; and a second focusing electrode including horizontal plate electrodes respectively formed at upper and lower sides of three electron beam through holes inserted into the vertically elongated electron beam through holes in the first focusing electrode, adapted to be applied of a dynamic voltage synchronous to a deflection of the electron beams, wherein the horizontal plate electrodes are horizontal burring portions formed in one end of the second focusing electrode toward cathodes, and further wherein the electron beam through holes in the second focusing electrode have key hole shapes, and wherein a dynamic quadrupole lens is formed among the vertical plate electrodes, the horizontal plate electrodes, and the inner electrode when applying the dynamic voltage to the second focusing electrode, and the intensity of the dynamic quadrupole lens can be controlled by controlling the depth of the inner electrode which is mounted in the first focusing electrode.

20. The focusing electrode of claim 19, wherein the three electron beam through holes in the inner electrode have any one of keyhole shapes, rectangular shapes, elliptical shapes, or circular shapes.

21. The focusing electrode of claim 19, wherein a length of the horizontal plate electrode at a center in the second focusing electrode is different from lengths of the outer horizontal plate electrodes.

22. The focusing electrode of claim 21, wherein the horizontal plate electrode at the center in the second focusing electrode is longer than lengths of the outer horizontal plate electrodes, and wherein the electron beam through hole at the center in the inner electrode has a vertically elongated shape and the outer electron beam through holes have circular shapes.

23. The focusing electrode of claim 22, wherein the electron beam through hole at the center in the inner electrode has any one of a key hole shape, a rectangular shape, or an elliptical shape.

24. A dynamic quadrupole lens comprising:

at least one cathode;

at least one anode;

a first electrode having an anode side and a cathode side, comprising:

vertical plates extending from the anode side toward the cathode side; and an inner electrode spaced apart from the vertical plates, and positioned on the cathode side of the vertical plates; and a second electrode comprising horizontal plates;

wherein the plates and the intensity of the dynamic quadrupole lens can be varied by varying a distance between the inner electrode and the vertical plates.

* * * * *